US010525576B1

(12) United States Patent
Chalifoux

(10) Patent No.: US 10,525,576 B1
(45) Date of Patent: Jan. 7, 2020

(54) NAIL HOLDER ASSEMBLY FOR A HAMMER

(71) Applicant: Paul Chalifoux, Naples, FL (US)

(72) Inventor: Paul Chalifoux, Naples, FL (US)

(73) Assignee: Paul R Chalifoux, Naples, FL (US)

( * ) Notice: Subject to any disclaimer, the term of this patent is extended or adjusted under 35 U.S.C. 154(b) by 0 days.

(21) Appl. No.: 16/389,953

(22) Filed: Apr. 21, 2019

(51) Int. Cl.
*B25D 1/04* (2006.01)
*B25G 1/08* (2006.01)

(52) U.S. Cl.
CPC ..... *B25D 1/04* (2013.01); *B25G 1/08* (2013.01)

(58) Field of Classification Search
CPC .. B25D 1/04; B25G 1/08; B25C 3/006; B25C 3/008
USPC ..... 81/44
See application file for complete search history.

(56) References Cited

U.S. PATENT DOCUMENTS 1,426,249 A * 8/1922 Bochonok ..... A43D 5/12 81/44
1,715,819 A * 6/1929 Dealy ..... B25C 3/008 81/426.5
3,060,442 A * 10/1962 Tomek ..... B25C 3/008 81/44
3,789,895 A * 2/1974 Levinson ..... B25C 3/008 81/44
4,841,819 A * 6/1989 Williams ..... B25B 9/02 29/278
4,843,923 A * 7/1989 Voss ..... B25C 3/004 81/44
5,153,974 A * 10/1992 Follens ..... B25B 27/0092 29/235
6,925,909 B2 * 8/2005 Crosby ..... B25B 9/02 81/44
8,479,612 B2 * 7/2013 Sergyeyenko ..... B25C 11/00 7/143
9,032,844 B2 * 5/2015 Bullard ..... B25C 3/008 81/44
2004/0040417 A1 * 3/2004 Davidson ..... B25C 3/008 81/44
2005/0166713 A1 * 8/2005 Lloyd ..... B25C 7/00 81/44

* cited by examiner

*Primary Examiner* — David B. Thomas

(57) ABSTRACT

Disclosed is a hammer assembly includes a hammer with a head portion and a handle portion with a cavity, and a nail holder assembly that includes a holder component and a sliding component, wherein the nail holder assembly is configured to be removably stored in the cavity of the handle portion of the hammer.

12 Claims, 7 Drawing Sheets

NAIL HOLDER ASSEMBLY FOR A HAMMER

TECHNICAL FIELD OF INVENTION

The present invention relates to nail holders, and in particular to a nail holder assembly that can be removably stored in a handle of a hammer.

BACKGROUND

It is common for a person to hold a nail by his hand (specifically fingers) when the person desires to drive the nail on walls or other surfaces using a hammer. While holding and striking the nail, if the hammer misses head of the nail, the hammer often impacts the fingers of the person.

Holding the nail with a holding device or a nail holder instead of by the hand makes visually locating the nail tip easier and reduces the risk of accidental injury during hammering. Many such holders for the nails have been known and used for many years to avoid injury to the person's fingers when driving nails.

One such nail holder is disclosed in U.S. Pat. No. 7,100,475 to Joseph Rufolo. The U.S. Pat. No. 7,100,475 discloses a nail holder that includes a handle and a head with a cantilever which is bifurcated and sized to receive a nail. The disclosed nail holder also includes a magnetic element mounted at the head.

U.S. Pat. No. 5,370,020 to Fifield, John T. and Fifield, Sandi H. discloses a nail holder which has the shape and appearance of a human hand and when held in the hand it holds the nail in a suitable position to be struck by a hammer. A very similar type of nail holder is disclosed in the U.S. Pat. No. 3,522,827 to Eric W. Muller.

Further, U.S. Pat. No. 4,201,258 assigned to The Stanley Works discloses a holder for nails that includes a pair of operating members with pivot means biasing the jaw portions of the operating members into normally closed position and with the handle portions being movable towards each other to open the jaw portions. The jaw portions have vertically extending inner side faces and inclined outer side faces tapering from a reduced cross section at the top faces thereof to a broad cross section adjacent the bottom faces thereof to hold nails of various diameters.

The above listed prior arts by their dates show that the holding of nails using the nail holders to avoid risk of injury to the fingers is a long standing need. However, typically, people often forget to bring the nail holder with them when they actually need the nail holder at their workplace.

Thus, some solutions are proposed in the past in the light of this issue, such as one disclosed in U.S. Pat. No. 3,788,373 to Aherin D. The U.S. Pat. No. 3,788,373 describes a nail holder associated with the hammer. The nail holder is supported from the neck of an associated hammer in a manner such that a nail may be removably clamped in position thereby in parallel relation with the neck of the hammer head and with the sharpened point of the nail projecting outwardly beyond the head of the hammer and the head of the nail abutted against the sleeve of the hammer head in which the associated hammer handle is secured. In this manner, the initial swinging of the hammer toward the workpiece will cause the supported nail to at least partially penetrate the workpiece. The grip of the nail holder on the nail is of the readily releasable type and after the nail has been initially started a slight lengthwise shifting of the hammer handle is sufficient to disengage the nail holder carried by the hammer head from the started nail. Thereafter, continued driving of the nail may be accomplished by striking the head of the hammer on the head of the nail in the conventional manner.

Similarly, U. S Patent Pub. No. 20110174116 discloses a hammer assembly having means for holding a nail. The hammer assembly includes a hammer and a nail holder. The nail holder is detachably mounted to the hammer to expose its one part or entirety outside an external surface of the hammer. When the nail holder is separated from the hammer, the nail holder can be used for holding a nail which is to be hit by the hammer. In this way, the user does not need to hold the nail by his or her hand to prevent the user's hand from any accidental hit of the hammer. Besides, when the nail holder is not needed, the user can mount it to the hammer.

Even solutions such as presented in the U.S. Pat. No. 3,788,373 and U.S. Patent Pub. No. US20110174116 are present to hold the nail or nail holder together with the hammer. It is desired to have an improved and a more reliable solution.

Further, conventionally available nail holders are constructed of plastic or metal with little ability to hold differently sizes of nails. Often, the conventionally available nail holders are so stiff that the hammer striking it lead to an injury and once the nail is hammered over the surface (such as on a woodwork), it is difficult to remove the holders out of the nail.

In the light of the above-mentioned background art, it is evident that, there is a need for an improved nail holder assembly for a hammer that can be removably stored in a hammer's handle, and such that the nail holder assembly would work with different sizes of nails, and can easily be removed out of the nail once the nail is hammered.

BRIEF SUMMARY

Accordingly, it would be advantageous to have a nail holder assembly that can be removably stored in a handle of a hammer ensuring the nail holder is always available.

It is another advantage of the present invention to provide the nail holder assembly that can fit to different sizes of nails and be easily removed from the nail once the nail has been hammered on a surface (such as wall, and woodwork) by simply lifting and pulling the holder away from the nail.

Another advantage of the present invention is to provide a nail holder assembly and a method of its use with different sizes of nails to avoid risk of injury during striking of the nail with the hammer.

Embodiments of the present invention discloses a hammer assembly having a hammer with a head portion and a handle portion, the handle portion of the hammer comprises a cavity of suitable dimensions, and a nail holder assembly configured to be removably stored in the cavity of the handle portion of the hammer.

According to the embodiments of the present invention, the nail holder assembly includes a holder component comprising a handle, and a core extension, the core extension comprises a first end and a second end, the first end of the core extension is attached to the handle and the second end of the core extension extends away from the handle, wherein the core extension comprises a hole near the second end for receiving a nail, and wherein the hole present near the second end of the core extension comprises at least one of: a first slot longitudinally extending towards the second end of the core extension, or a second slot longitudinally extending towards the second end of the core extension and extending partially towards the first end of the core extension.

According to the embodiments of the present invention, the nail holder assembly further includes a sliding component comprising a proximal end and a distal end, wherein the sliding component is configured to receive the core extension of the holder component such that the second end of the core extension with the hole comes out of the sliding component, and wherein the distal end of the sliding component comprises a notch of a predefined shape that enables the nail holder assembly to hold the nail when the sliding component is slidably moved forward against the nail to hold and drive the nail on a surface using the hammer.

According to the embodiments of the present invention, the predefined shapes of the notch present at the distal end of the sliding component is at least one of a circular, oval, square, rectangular, diamond, or triangular.

According to the embodiments of the present invention, the hole present near the second end of the core extension is at least one of a circular, oval, square, rectangular, triangular, diamond, tear, or hexagonal.

According to the embodiments of the present invention, the sliding component is substantially smaller in length than the core extension of the holder component.

According to the embodiments of the present invention, the notch present at the distal end of the sliding component is configured to secure first side of the nail while a second side of the nail is secured against the hole when the nail holder assembly is in use.

According to the embodiments of the present invention, at least one of: the first slot or the second slot creates a pair of movable segments that facilitates removal of the holder component of the nail holder assembly out of the nail (just by a pull of the nail holder assembly backward) once the nail is hammered on the surface.

Various objects, features, aspects and advantages of the present invention will become more apparent from the following detailed description of the embodiments of the invention, along with the accompanying drawings in which like numerals represent like components.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Various embodiments will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

References to "one embodiment", "an embodiment", "another embodiment", "an example", "another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. Unless stated otherwise, terms such as "first", "second", "third", "fourth", are used to arbitrarily distinguish between the elements such terms describe. Thus, these terms are not necessarily intended to indicate temporal or other prioritization of such elements.

The various features and embodiments of a nail holder assembly for a hammer, or a hammer assembly having a nail holder assembly removably storable therein will now be described in conjunction with the accompanying figures, namely FIGS. 1-7.

Figure 1:
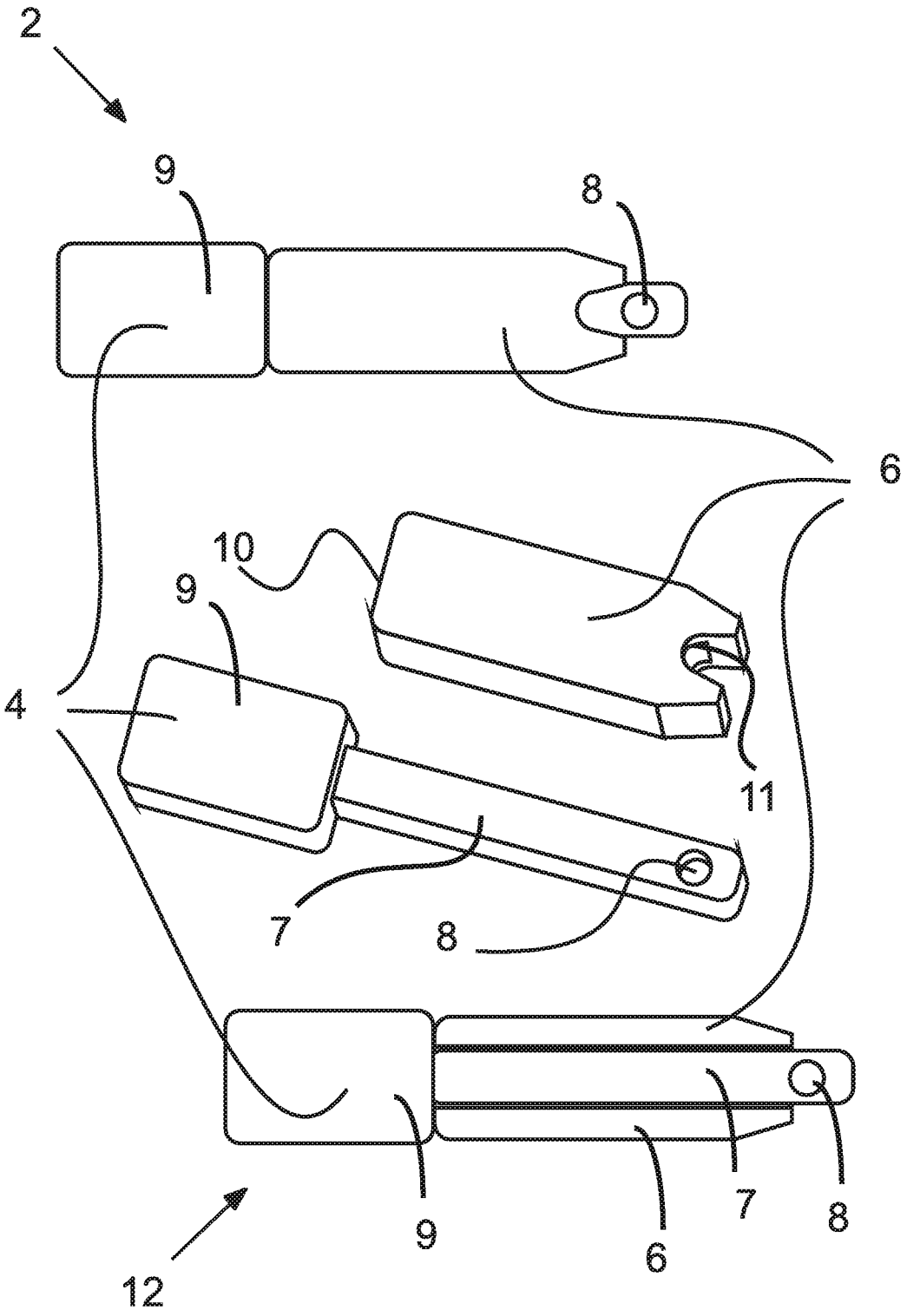
FIG. 1 shows a top view, an exploded view and a cross sectional view of a nail holder assembly of the present invention, according to an exemplary embodiment of the present invention.

Referring to accompanying figures, especially FIG. 1 that shows a top view, an exploded view and a cross sectional view of a nail holder assembly of the present invention, according to an exemplary embodiment of the present invention. As seen, the nail holder assembly 2 in the top view and the exploded view, and the nail holder assembly 12 in the cross sectional view includes a holder component 4, and a sliding component 6.

The holder component 4 includes a handle 9, and a core extension 7. The core extension 7 comprises a first end and a second end. The first end of the core extension 7 is attached to the handle 9 at an end of the handle 9 and the second end of the core extension 7 extends away from the handle 9. As seen, the core extension includes a hole 8 near the second end of the core extension 7 for receiving a nail (not shown). The hole 8 is preferably made large enough to accept different sizes of nails. The hole 8 present near the second end of the core extension 7 may be made circular, oval, square, rectangular, triangular, diamond, tear, or hexagonal or the like. In the preferred embodiment, the hole 8 may be made circular.

The core extension 7 is substantially uniform in diameter and is shaped in the form of a rectangular box. According to the embodiment, the core extension 7 may be made using suitable materials such as but not limited to rubber or plastic and configured into a length suitable for a person holding the nail holder assembly 2 to avoid any injury risk when the person hammers the nail held on the nail holder assembly 2. Preferably, the material for the core extension 7 is soft and elastic enough such that the nail can be pulled through slot connecting the hole to the second end of the core extension 7 after being hammered which will be described in the descriptions to follow in the context of different embodiments. Also, as seen, the core extension 7 may have a width lesser than the width of the handle 9 of the holder component 4. In some embodiment, the handle 9 may have width equivalent to or lesser than the width of the core extension 7. According to the embodiment, the handle 9 may preferably be made of polyethylene rubber. In some other embodiments, the handle 9 may be made of polypropylene plastic with living hinges on the end.

The sliding component 6 includes a proximal end and a distal end and is configured to receive the core extension 7 of the holder component 4 via a central through hole present at the proximal end 10 of sliding component 6. The sliding component 6 is preferably made of plastic material particularly polypropylene, ABS or nylon. In some other embodiments, the sliding component 6 may be made of different metals, or rubber or the like materials. The sliding component 6 is suitably shaped and dimensioned to fit over the core extension 7. The sliding component 6 is substantially smaller in length than the core extension 7 of the holder component 4. In some embodiment, the core extension 7 width may be made larger than internal width of the sliding component 6 at some point along its length. When the sliding component 6 is in fully retracted configuration (when not moved forward), that the second end of the core extension 7 with the hole 8 is disposed out of the sliding component 6 as seen in the top view 2 and the cross sectional view 12 of the nail holder assembly of FIG. 1.

Further as seen, the distal end of the sliding component 6 comprises a notch 11 of a predefined shape that enables the nail holder assembly 2 to hold the nail when the sliding component 6 is slidably moved forward against the nail to hold and drive the nail on a surface using a hammer (not shown). The predefined shape of the notch 11 may include but not limited to a semicircular, circular, semi oval, semi square, square, semi rectangular, rectangular, semi diamond, diamond, semi triangular, or triangular. According to the preferred embodiment, the notch 11 may be made circular.

In operation, the nail is first placed into the hole 8. Then, the sliding component 6 is slidably moved forward to press against the nail to secure it to carry out hammering operation using a hammer. The notch 11 of the sliding component 6 provides improved contact with the nail. The sliding component 6 provides contact at two points (upper and lower side) at the hole 8 as seen in a cross sectional side view of the nail holder assembly (shown in use) in FIG. 3. Next, once the hammering is done, the sliding component 6 is slidably moved backward to release the nail. For releasing the nail, the nail holder assembly 2 is lifted upward so that the nail is removed from the hole 8 present in the core extension 7 of the holder component 4.

Figure 2:
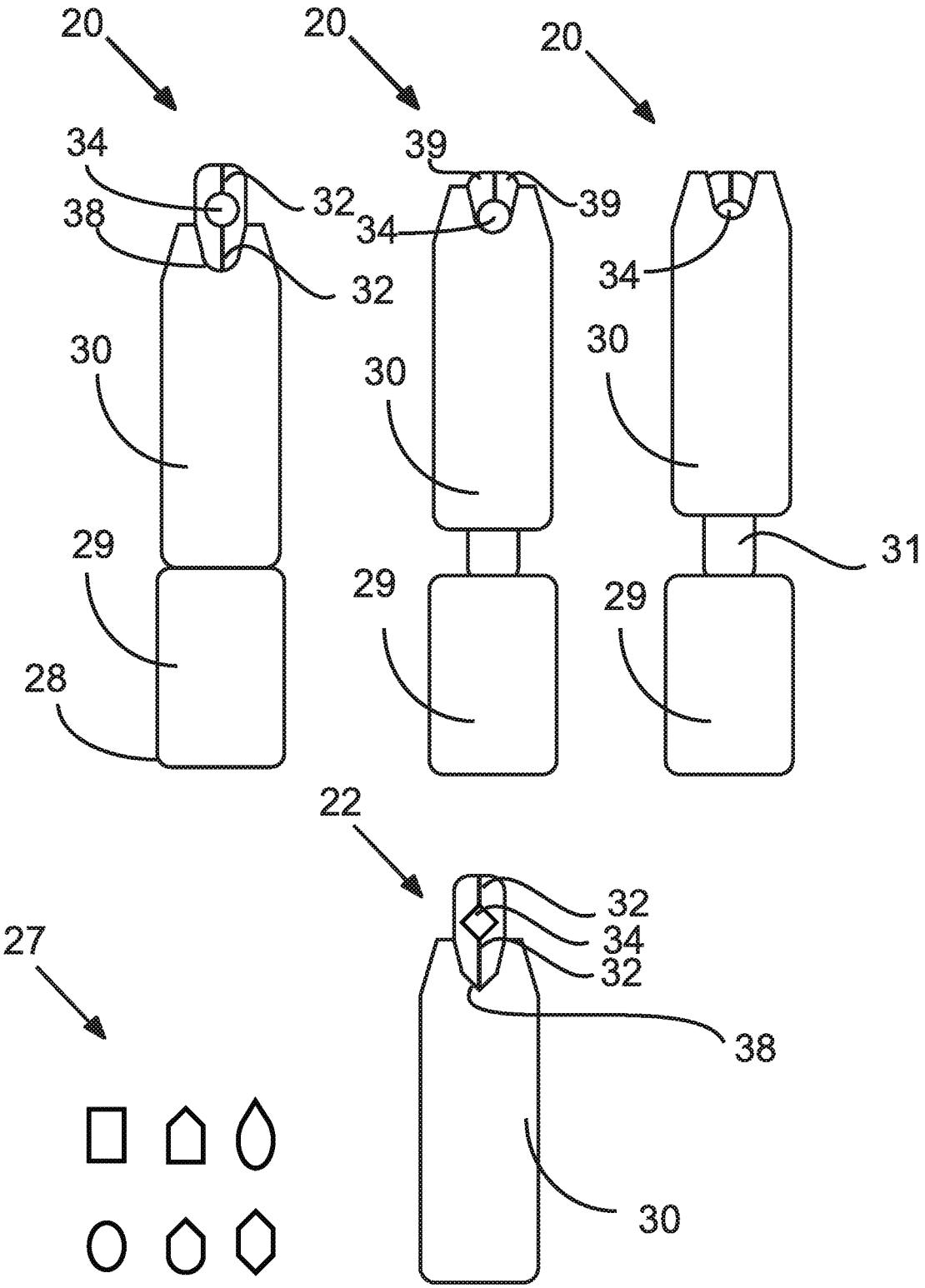
FIG. 2 shows top views of the nail holder assembly of the present invention with a sliding component of the nail holder assembly moved forward to secure a nail, according to an exemplary embodiment of the present invention.

Referring to FIG. 2, top views of the nail holder assembly of the present invention with a sliding component of the nail holder assembly moved forward to secure a nail is shown, according to an exemplary embodiment of the present invention. As seen, the nail holder assembly 20 includes a holder component 28, and a sliding component 30. The sliding component 30 includes a notch 38 present at the distal end thereof and the holder component 28 includes a handle 29, and a hole 34 similar to what is described above with respect to the FIG. 1. However, the hole 34 present near the second end of the core extension 31 may comprise a first slot 32 longitudinally extending towards the second end of the core extension 31 as best seen in a partial cross sectional view 94 of the core extension section 31 of the holder component 28 in FIG. 6 or a second slot 32 longitudinally extending towards the second end of the core extension 31 and extending partially towards the first end of the core extension 31 as seen in the FIGS. 2, 4 and 5 and a partial cross sectional view 97 of the core extension 31 of the holder component 28 in the FIG. 6.

Figure 6:
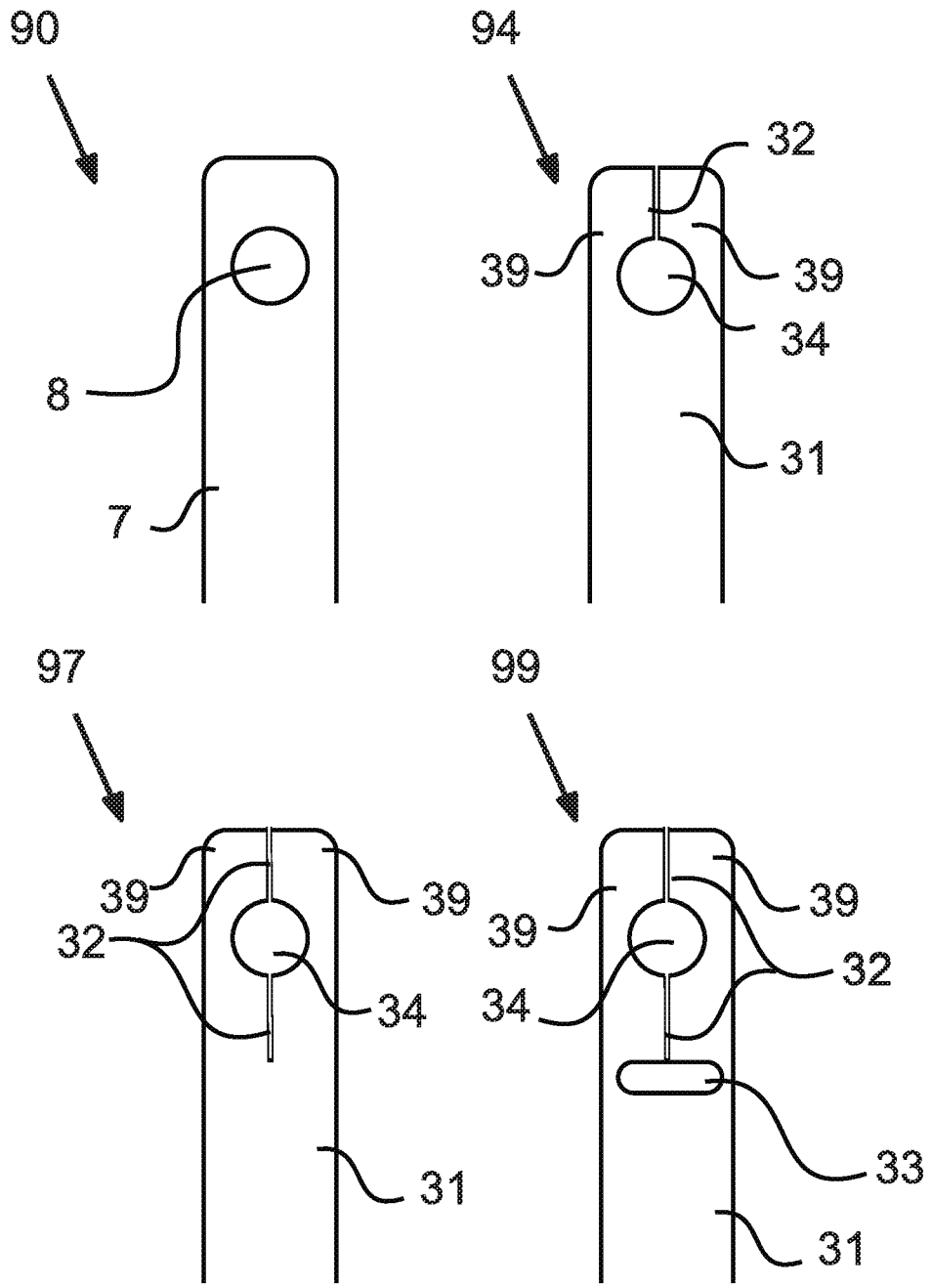
FIG. 6 shows partial cross sectional views of a core extension section of the holder component with different hole and slot configurations, according to various embodiments.

Also, the first slot 32 or the second slot 32 are through slots that create a pair of movable segments 39 (as seen in FIGS. 2 and 6) that facilitates removal of the holder component 28 of the nail holder assembly 20 out of the nail once the nail is hammered on the surface.

Referring back to the FIG. 2, different sizes of nails (not shown) may be secured by moving the sliding component 30 forward. As seen, the forward movement of the sliding component 30 gradually decreases size of the hole 34 thus facilitating the nail holder assembly 20 to hold varying sizes of the nails places into the hole 34.

Further, the hole 34 in the holder component 28 can be of shapes 27 including but not limited to circular, oval, square rectangular, triangular, diamond, tear, hexagonal, combinations or other common shapes. As seen in the FIG. 2, the hole 34 in the nail holder assembly 20 is circular whereas the hole 34 in the partially shown nail holder assembly 22 is in a diamond shape. It should be understood that, the shape of the hole 34 is preferably chosen such that the shape of the hole 34 complement the shape of the notch 38 of the sliding component 30. As seen, for the circular hole 34 in the nail holder assembly 20 the chosen notch is circular or semicircular, whereas for the diamond shaped hole 34 in the partially shown nail holder assembly 22 the chosen shape of the notch 38 is triangular.

In operation, when the sliding component 30 is moved forward to hold the nail after the placement of the nail into the hole 34, the pair of segments 39 are covered and secured and cannot open up or get separated. Once the nail is hammered on a desired surface, the sliding component 'is retracted or moved back. Next, once the sliding component is moved back, the nail holder assembly 20 in pulled back by the person with a slight force that forces the hammered nail to come out through the slot 32. The pair of segments 39 bend at the hole 34. The presence of slot 32 facilitates easy removal of the nail holder assembly after the hammering action is performed by the person and due to the presence of the slot 32, the person don't have to lift up or move up the nail holder assembly 20 for removal of the assembly 20 out of the nail present in the hole 34 (such removal may sometimes strike nail's head portion) as described with respect to the FIG. 1.

Figure 3:
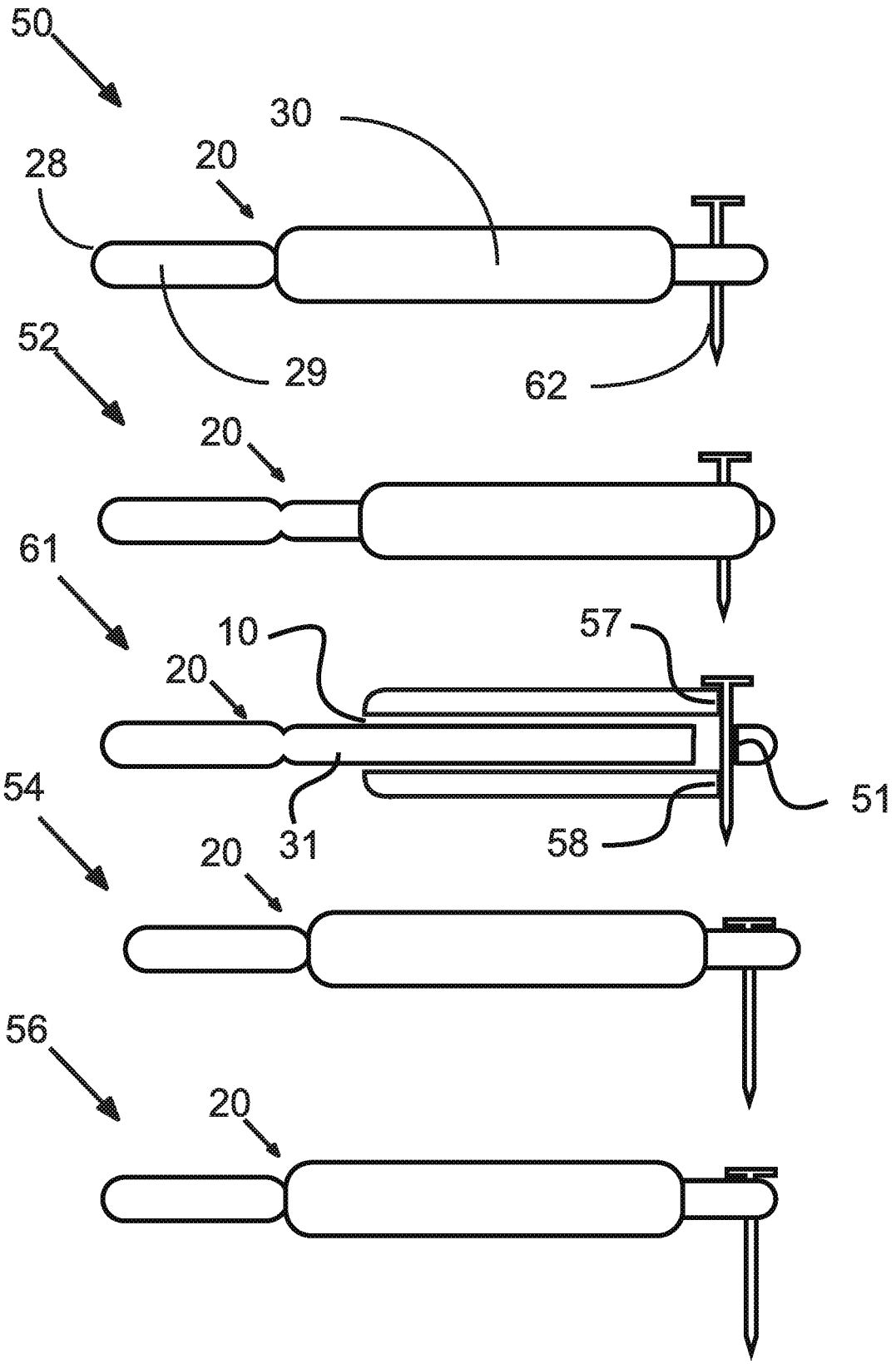
FIG. 3 shows side views and a cross sectional side view of the nail holder assembly in use, according to an exemplary embodiment of the present invention.
Figure 4:
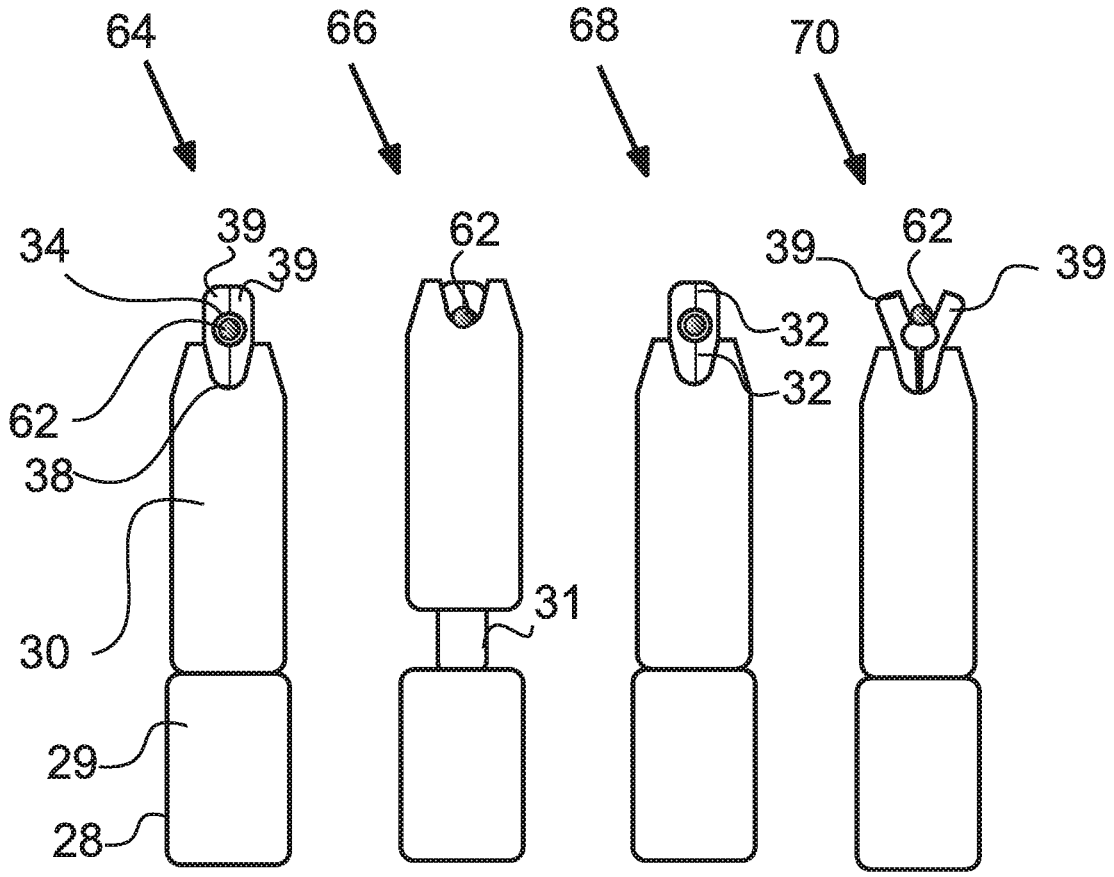
FIG. 4 shows top views of the nail holder assembly of FIG. 3 in use, specifically showing various stages adapted for holding and releasing a nail.

Referring to FIG. 3, side views and a cross sectional side view of the nail holder assembly in use are shown, according to an exemplary embodiment of the present invention. Referring to FIG. 4, top views of the nail holder assembly of FIG. 3 in use are shown, specifically the FIGS. 3-4 shows various stages adapted for holding and releasing a nail. As seen, the top views 64, 66, 68, 70, the side views 50, 52, 54, 56 and the cross sectional side view 61 of the nail holder assembly 20 demonstrates method of use of the nail holder assembly 20.

Assuming the holder component 28 is placed inside the sliding component 30 with the sliding component 30 in a fully retracted position. Fully retracted position refers to the position of the sliding component 30 when the sliding component 30 is fully pulled backward such that the proximal end of the sliding component 30 meet the end of the handle 29 of the holder component 28. As seen, in the side view 50 and 64, a nail 62 with a specific size or diameter is initially inserted into the hole 34 present in the core extension 31 of the holder component 28. Next, as seen in the side view 52 and 66, the sliding component 30 is moved forward to press against the nail 62 and secure the nail 62 in the hole 34. One side of the nail 62 is secured against a wall 51 of the hole 34 while the opposite side of the nail 62 is secured against the notch 38 present in the sliding component 30. The notch 38 secures the nail 62 at two contact points (an upper contact point 57 and a lower contact point 58) with the nail 62 as best seen in the cross sectional side view 61 of the FIG. 3. It can be concluded from the cross sectional side view 61 of the nail holder assembly there are three obvious points of contact that holds the nail 62 in position before the person initiates hammering action, however, the number of contact points that that may hold the nail 62 may vary (increase or decrease) with different shapes chosen for the hole 34 and the notch 38. For example, diamond shaped hole and the complementing notch will have two points of contact with the nail 62 to hold the nail 62 in position.

Next, as seen in the side view 54 and 68, the sliding component 30 is retracted or slidably pulled back after the nail 62 is hammered on the desired surface. This releases pressure on the nail 62. Next, as seen in the side view 56 and 70, the nail holder assembly 20 is pulled back with a slight force by the person, this allows the nail 62 to move out of the hole 38 through the slot 32 that extends from the hole 34 to the end of the core extension 31. The pullback action of the assembly 20 opens up or separates a pair of segments or lateral segments 39 allowing the nail 62 to get released from the hole 38. Lifting of the nail holder assembly 20 upwards to release the nail 62 is not required in this embodiment of the nail holder assembly 20 design unlike the one described above with respect to the FIG. 1.

Figure 5:
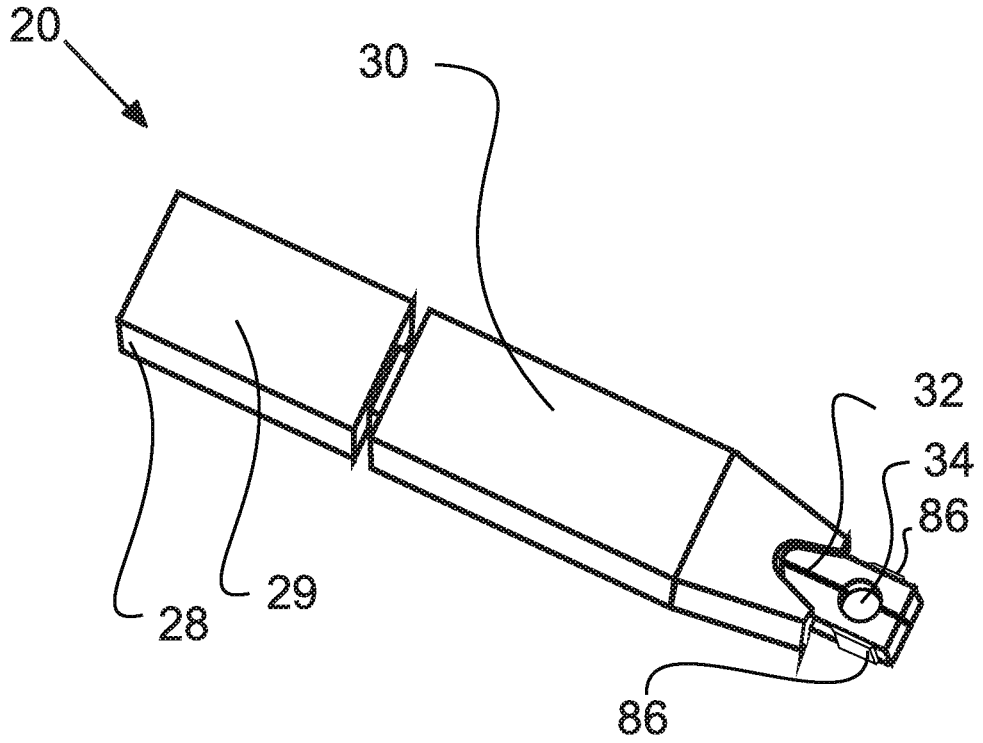
FIG. 5 shows an isometric view of an alternative exemplary embodiment of the nail holder assembly with a slot extending through a hole to lateral segments of an end of a holder component.
Figure 5:
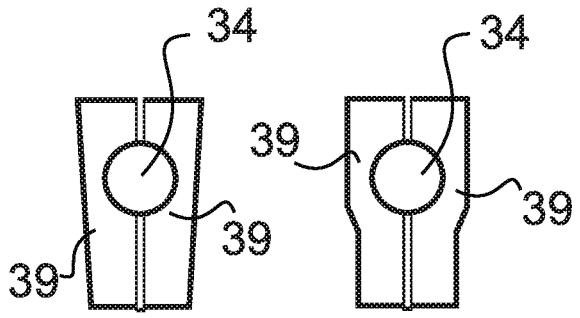

Referring to FIG. 5, an isometric view of an alternative embodiment for the nail holder assembly with a slot extending through a hole to lateral segments of an end of a holder component is shown. As seen, the nail holder assembly 20 consists of holder component 28 and the sliding component 30. The slot 32 is configured as a through opening at the end of holder component 28 which extends through the hole present in the sliding component 30. The slot opening may create problems with very small sized nails (one with lesser diameter compared to the diameter of the slot's opening), as such small sized nails can enter the slot opening. As a solution, according to an embodiment, the a pair of lateral extensions 86 (on left side and right side) may be provided as shown in the FIG. 5. The presence of the lateral extensions 86 provide increased dimension, such that when the sliding component covers these lateral extensions 86, an inward pressure closes slot 32. Further, as an alternative, a simple cut or slice may be used in the two sides however, this can add to manufacturing costs.

Referring to the FIG. 6, partial cross sectional views of a core extension section of the holder component with different hole and slot configurations are shown, according to various embodiments. As seen, the view 90 shows just the hole 8 at an end of the core extension 7 as described with respect to the FIG. 1 above wherein the nail (after hammering is done) is removed by pulling the nail holder assembly 2 upward and over the nail. The view 94 shows an alternative configuration where the hole 34 includes a first slot or slot 32 longitudinally extending towards the second end of the core extension 31 of the holder component 28. Likewise, in another embodiment shown in the views 97 and 99, the hole 34 includes a second slot or a slot 32 longitudinally extending towards the second end of the core extension 31 from an end of the hole 34 and extending partially towards the first end of the core extension 31 from opposite end of the hole 34 as seen and described with respect to FIGS. 2, 4 and 5. Further, the extended slot or slice 32 shown in the view 97 facilitates added release of the nail holder assembly from the nail after the nail is hammered. The view 99 shown for the hole 34 and the slot 32 uses an additional slot or living hinge 33 specifically designed for use with stiffer materials.

Figure 7:
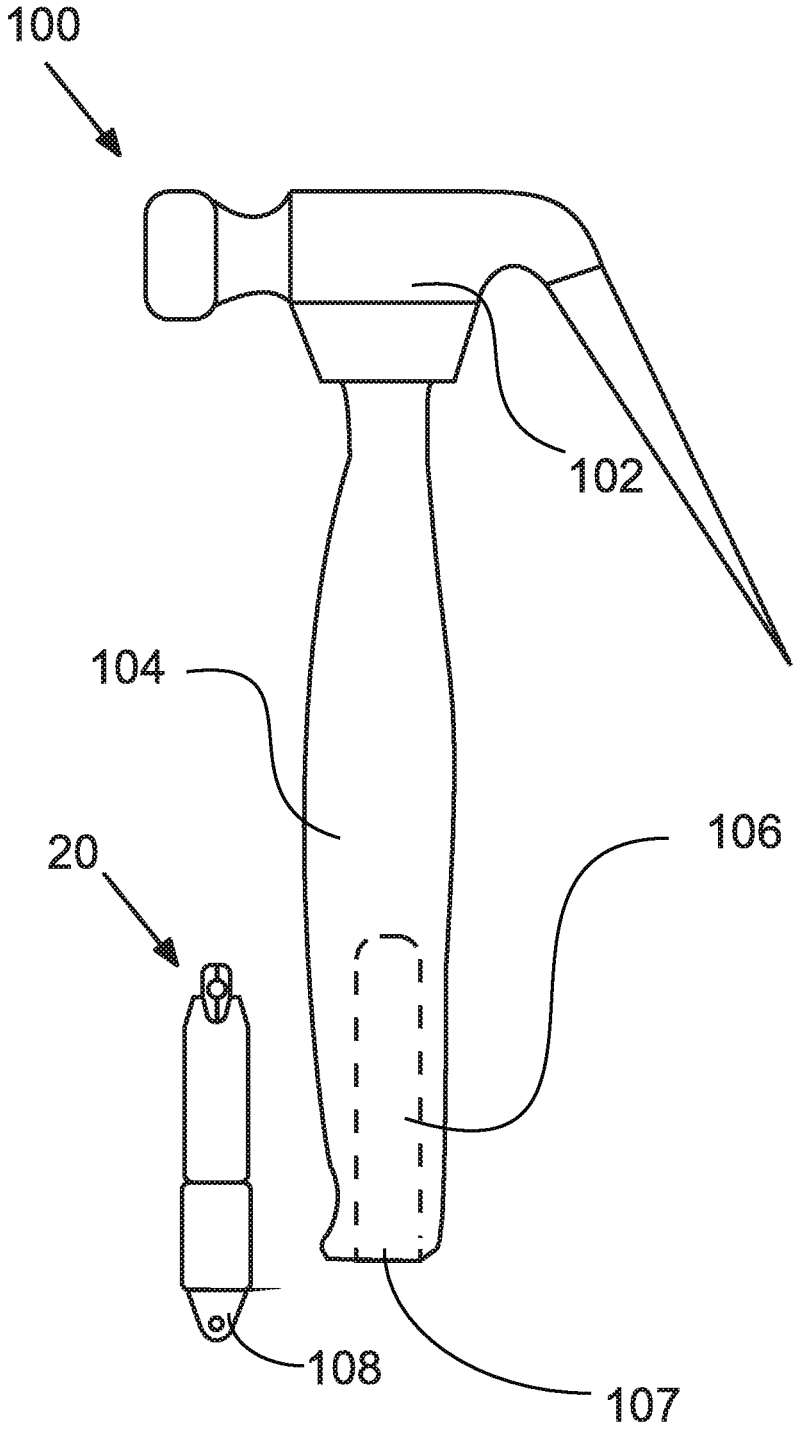
FIG. 7 shows storage of the nail holder assembly in a handle of a hammer, according to an exemplary embodiment of the present invention.

Referring to FIG. 7, storage of the nail holder assembly in a handle of a hammer is shown, according to an exemplary embodiment of the present invention. As seen, the hammer 100 may be any type of traditionally known hammer with a head portion 102 and a handle portion 104. However, in the proposed hammer assembly, the handle portion 104 of the hammer 100 will be configured to include an entry hole or opening at its free end 107. The entry hole at the end 107 of the handle portion 104 will preferably extend towards the head portion 102 of the hammer 100 to form a cavity 106 (represented with the dotted line) of suitable dimensions for receiving and storage of the nail holder assembly 20 therein, when the nail holder assembly 20 is not in use. The cavity's 106 dimension would be such that it would complement to the size or dimensions of the nail holder assembly 20. This would ensure the availability of the nail holder assembly 20 to the person at work. In operation, after the nail holder assembly 20 is used, then the nail holder assembly 20 will be guided through the hole or opening at the end 107 of the hammer handle 104 and finally into the cavity 106 for storage. The nail holder assembly 20 may also be provided with some pull-push provision 108 attached or built on the holder component. The pull-push provision 108 is meant to facilitate guiding and removal the nail holder assembly 20 to and from the cavity 106 present in the handle 104 of the hammer 100. The nail holder assembly 20 may be designed for snap retention, friction fit, interlocking or other common methods of retention inside the cavity 106 present in the handle 104 of the hammer 100.

The nail holder assembly described above may be made of known materials such as plastic, metal or rubber and may be manufactured by using common methods such as injection molding or 3D printing. The sue of materials such as polypropylene may require use of living hinges to allow hole expansion and release of the nail.

Further, the nail holder assembly described above may be used for variety of shape and sizes of nails. However, circular nails with specific diameter are preferred for use as such nails are secured against multiple points of contact to aid stabilization of nail during the hammering of the nail on the surface using the hammer.

It should be noted that, the nail holder assembly 20 and the hammer assembly comprising the hammer designed to store the nail holder assembly 20 and associated components thereof described above in the FIGS. 1-7 may be made of many other suitable material known in the art, and be made in different sizes that may make the presented invention realization in real scenario.

It should be understood according to the preceding description of the present invention that the same is susceptible to changes, modifications and adaptations, and that the said changes, modifications and adaptations fall within scope of the appended claims.

What is claimed is:

1. A nail holder assembly (20) for a hammer (100), comprising:

a holder component (28) comprising a handle (29), and a core extension (31), the core extension (31) comprises a first end and a second end, the first end of the core extension (31) is attached to the handle (29) and the second end of the core extension (31) extends away from the handle (29), wherein the core extension (31) comprises a hole (34) near the second end for receiving a nail (62), and wherein the hole (38) present near the second end of the core extension (31) is at least one of a circular, oval, square, rectangular, triangular, diamond, tear, or hexagonal and wherein the hole (38) comprises at least one of: a first slot (32) longitudinally extending towards the second end of the core extension (31), or a second slot (32) longitudinally extending towards the second end of the core extension (31) and extending partially towards the first end of the core extension (31); and a sliding component (30) comprising a proximal end and a distal end, wherein the sliding component (30) is configured to receive the core extension (31) of the holder component (28) such that the second end of the core extension (31) with the hole (34) is disposed out of the sliding component (30), and wherein the distal end of the sliding component (30) comprises a notch (38) of a predefined shape that enables the nail holder assembly (20) to hold the nail (62) when the sliding component (30) is slidably moved forward against the nail (62) to hold and drive the nail (62) on a surface using the hammer (100).

2. The nail holder assembly (20) of claim 1, wherein the predefined shape of the notch (38) present at the distal end of the sliding component (30) is at least one of a circular, semi-circular, oval, semi-oval, square, semi-square, rectangular, semi-rectangular, diamond, or triangular.

3. The nail holder assembly (20) of claim 1, wherein the sliding component (31) is substantially smaller in length than the core extension (31) of the holder component (28).

4. The nail holder assembly (20) of claim 1, wherein the notch (38) is configured to secure first side of the nail (62) while a second side of the nail (62) is secured against the hole (38) when the nail holder assembly (20) is in use.

5. The nail holder assembly (20) of claim 1, wherein the at least one of: the first slot (32) or the second slot (32) creates a pair of movable segments (39) that facilitates removal of the nail holder assembly (20) out of the nail (62) once the nail (62) is hammered on the surface.

6. The nail holder assembly (20) of claim 1, wherein the hammer (100) comprises a head portion (102) and a handle portion (104), the handle portion (104) includes an entry hole at a free end 107 thereof, and wherein the entry hole (107) of the handle portion (104) extends towards the head portion (102) of the hammer (100) to form a cavity (106) of suitable dimensions that enables storage of the nail holder assembly (102), when the nail holder assembly (20) is not in use.

7. A hammer assembly, comprising:

a hammer (100) with a head portion (102) and a handle portion (104), the handle portion (104) of the hammer (100) comprises an entry hole at a free end 107 thereof, the entry hole of the handle portion (104) extends towards the head portion (102) of the hammer (100) to form a cavity (106) of suitable dimensions; and a nail holder assembly (102) configured be removably stored in the cavity (106) of the handle portion (104) of the hammer (100), and wherein the nail holder assembly (20) comprising:

a holder component (28) comprising a handle (109), and a core extension (31), the core extension (31) comprises a first end and a second end, the first end of the core extension (31) is attached to the handle (29) and the second end of the core extension (31) extends away from the handle (29), wherein the core extension (31) comprises a hole (38) near the second end for receiving a nail (62), and wherein the hole (38) present near the second end of the core extension (31) comprises at least one of: a first slot (32) longitudinally extending towards the second end of the core extension (31), or a second slot (32) longitudinally extending towards the second end of the core extension (31) and extending partially towards the first end of the core extension (31); and a sliding component (30) comprising a proximal end and a distal end, wherein the sliding component (30) is configured to receive the core extension (31) of the holder component (28) such that the second end of the core extension (31) with the hole (38) comes out of the sliding component (30), and wherein the distal end of the sliding component (30) comprises a notch (38) of a predefined shape that enables the nail holder assembly (20) to hold the nail (62) when the sliding component (30) is slidably moved forward against the nail (62) to hold and drive the nail (62) on a surface using the hammer (100).

8. The hammer assembly of claim 7, wherein the predefined shape of the notch (38) present at the distal end of the sliding component (30) is at least one of a circular, semi-circular, oval, semi-oval, square, semi-square, rectangular, semi-rectangular, diamond, or triangular.

9. The hammer assembly of claim 7, wherein the hole (38) present near the second end of the core extension (31) is at least one of a circular, oval, square, rectangular, triangular, diamond, tear, or hexagonal.

10. The hammer assembly of claim 7, wherein the sliding component (30) is substantially smaller in length than the core extension (31) of the holder component (28).

11. The hammer assembly of claim 7, wherein the notch (38) present at the distal end of the sliding component (30) is configured to secure first side of the nail (62) while a second side of the nail (62) is secured against the hole (38) when the nail holder assembly (20) is in use.

12. The hammer assembly of claim 7, wherein the at least one of: the first slot (32) or the second slot (32) creates a pair of movable segments (39) that facilitates removal of the nail holder assembly (20) out of the nail (62) once the nail (62) is hammered on the surface.

* * * * *